US012115461B2

(12) United States Patent
Basyuk

(10) Patent No.: US 12,115,461 B2
(45) Date of Patent: Oct. 15, 2024

(54) IMAGE-BASED PUZZLE AND A METHOD OF MAKING THEREOF

(71) Applicant: Simon Basyuk, Millburn, NJ (US)

(72) Inventor: Simon Basyuk, Millburn, NJ (US)

( * ) Notice: Subject to any disclaimer, the term of this patent is extended or adjusted under 35 U.S.C. 154(b) by 0 days.

(21) Appl. No.: 18/115,011

(22) Filed: Feb. 28, 2023

(65) Prior Publication Data

US 2024/0286024 A1 Aug. 29, 2024

(51) Int. Cl.
*A63F 9/10* (2006.01)

(52) U.S. Cl.
CPC .... *A63F 9/1044* (2013.01); *A63F 2009/1072* (2013.01)

(58) Field of Classification Search
CPC ... A63F 9/10; A63F 9/1044; A63F 2009/1072
See application file for complete search history.

(56) References Cited

U.S. PATENT DOCUMENTS 1,480,458 A * 1/1924 Mershon ..... G09B 11/04 434/84
1,714,127 A * 5/1929 Graham ..... A63F 9/10 273/157 R
1,972,206 A * 9/1934 Thomay ..... A63F 9/10 273/157 R
2,659,163 A * 11/1953 Wilder ..... A63F 9/0666 273/273
2,825,568 A 3/1958 Birsh
3,010,723 A 11/1961 Moss
3,665,617 A 5/1972 Gilbert
3,923,307 A 12/1975 Sukys
3,964,749 A 6/1976 Wadsworth
D281,791 S * 12/1985 Dobrzynski ..... 273/153 S
4,586,714 A * 5/1986 Lenkoff ..... A63F 9/10 156/62
4,756,533 A * 7/1988 Hopkins ..... A63F 9/10 273/157 R
4,838,551 A * 6/1989 Volpert ..... A63F 9/1011 273/273

(Continued)

*Primary Examiner* — Steven B Wong

(57) ABSTRACT

A puzzle comprising a set of puzzle pieces and a puzzle assembly surface having a puzzle assembly image printed thereon, the image includes blank areas corresponding to sections of a source image and background puzzle image corresponding to complementary sections of the source image. Each of the puzzles has an image printed on it that corresponds to a particular region of the source image. Shape and size of the puzzle pieces and the images printed on them are such that, when each puzzle piece is placed on the puzzle assembly surface in a particular position with a particular orientation covering a particular blank areas and a portion of the background puzzle image directly surrounding the blank area, a region of the background puzzle image that remains uncovered by the puzzle piece is complementary to the image printed thereon. Thereby, when all puzzle pieces are placed on the puzzle assembly surface in their corresponding positions with corresponding orientations, each covering corresponding blank area, the images printed on the puzzle pieces together with the regions of the background puzzle image that are left uncovered by the puzzle pieces form an image that is generally identical to the source image.

12 Claims, 5 Drawing Sheets

(56) References Cited

U.S. PATENT DOCUMENTS

| | | | | | |
|---|---|---|---|---|---|
| 5,209,480 | A | | 5/1993 | Katz | |
| 5,439,220 | A | * | 8/1995 | Hendricks | A63F 9/10 273/157 R |
| 5,575,658 | A | | 11/1996 | Barnard | |
| 5,577,728 | A | | 11/1996 | Kondo | |
| 5,628,513 | A | | 5/1997 | Soriano | |
| 5,692,749 | A | | 12/1997 | Vogeler | |
| 5,823,532 | A | | 10/1998 | Goldwasser | |
| 5,829,744 | A | * | 11/1998 | Nelson | A63F 9/10 273/153 R |
| 5,979,895 | A | * | 11/1999 | Dove | G09B 1/06 434/238 |
| 5,980,354 | A | | 11/1999 | Prest | |
| 6,012,718 | A | | 1/2000 | McClellan | |
| 6,062,864 | A | | 5/2000 | Rood | |
| 6,098,980 | A | | 8/2000 | Ramage | |
| 6,331,018 | B1 | | 12/2001 | Roth | |
| 6,336,631 | B1 | * | 1/2002 | Volkert | A63F 9/10 273/157 R |
| 6,361,045 | B1 | * | 3/2002 | Bernstein | A63F 9/10 273/157 R |
| 6,431,544 | B1 | | 8/2002 | Kagami | |
| 8,573,596 | B2 | | 11/2013 | Gearty | |
| 9,114,313 | B2 | | 8/2015 | Weed | |
| 9,403,084 | B2 | | 8/2016 | Volkert | |
| 10,350,483 | B1 | | 7/2019 | Basyuk | |
| 2005/0200076 | A1 | * | 9/2005 | Wu | A63F 9/10 273/157 R |
| 2008/0224396 | A1 | | 9/2008 | Cocis | |
| 2012/0049451 | A1 | | 3/2012 | Juenger | |
| 2015/0209661 | A1 | | 7/2015 | Klemm | |
| 2016/0089598 | A1 | | 3/2016 | Wang | |

* cited by examiner

IMAGE-BASED PUZZLE AND A METHOD OF MAKING THEREOF

CROSS REFERENCE TO RELATED APPLICATION(S)

The present application claims the benefit of U.S. Provisional Application No. 63/315,204, filed Mar. 1, 2022, titled "AN IMAGE-BASED PUZZLE AND A METHOD OF MAKING THEREOF".

FIELD AND BACKGROUND OF THE DISCLOSED TECHNOLOGY

The disclosed technology relates generally to games and, more specifically, to a printed puzzle and to a method of making thereof.

U.S. Pat. No. 6,336,631 to Volkert is directed to a two-sided puzzle having a transparent backing sheet to which a set of puzzle pieces are attached by pressure-sensitive adhesive to one surface which set can be reassembled in a frame region to display a hidden promotional message. Another embodiment prints both sides of two sheets that are then laminated together via pressure-sensitive adhesive to create a lamination that contains a pair of puzzles that are solved through the use of a visage that only becomes exposed to view once a set of die-cut puzzle pieces is removed.

U.S. Pat. No. 10,688,384 to Basyuk is directed to a puzzle including a background puzzle surface having printed thereon a background puzzle image including image areas and blank areas, and at least one puzzle piece formed of a transparent material having printed thereon a puzzle piece image including image areas and blank transparent areas. When solving the puzzle, the at least one puzzle piece is superimposed over the background puzzle surface and is moved thereon to a correct location in which the image areas of the background puzzle image together with the image areas of the puzzle piece image match and form a cohesive image.

SUMMARY OF THE INVENTION

The disclosed technology relates generally to games and, more specifically, printed puzzles and methods of making thereof.

According to an embodiment of the teachings herein, there is provided a puzzle comprising:

(a) a sheet of puzzle pieces comprising a release sheet and a face stock detachably coupled thereto, a front surface of the face stock has at least one extended piece image provided thereon covering at least one sector of the front surface, the at least one extended piece image corresponds to at least one region of a source image, at least one closed-shape cut laying inside the at least one sector cuts through the face stock so forming at least one puzzle piece having at least one puzzle piece image provided thereon; and (b) a puzzle assembly surface having a puzzle assembly image provided thereon, the puzzle assembly image including:

(i) blank areas corresponding to non-overlapping sections of the source image, the blank areas each having an image therein blanked out; and (ii) a background puzzle image corresponding to complementary sections of the source image which are complementary to the non-overlapping sections of the source image;

wherein shape and size of the at least one puzzle piece and the at least one puzzle piece image provided thereon are such that, when the at least one puzzle piece is placed upon the puzzle assembly surface in a particular position with a particular orientation, the at least one puzzle piece covers a region of the puzzle assembly image including a particular blank area of the blank areas and a portion of the background puzzle image directly adjoining the particular blank area such that the at least one puzzle piece image is complementary to a portion of the background puzzle image that is left uncovered by the at least one puzzle piece;

thereby, when the at least one puzzle piece is placed on the puzzle assembly surface in the particular position with the particular orientation, the at least one puzzle piece image together with regions of the background puzzle image that are uncovered by the at least one puzzle piece, collectively form an image that is generally identical to the source image.

In a preferred embodiment, the at least one extended piece image includes a plurality of extended piece images corresponding to a plurality of regions on the source image, the at least one puzzle piece includes a plurality of puzzle pieces and the at least one puzzle piece image includes a plurality of puzzle piece images; extended piece images of the plurality of extended piece images are jumbled relatively to corresponding regions of the plurality of regions on the source image; quantity of puzzle pieces of the plurality of puzzle pieces is equal to quantity of the blank areas; puzzle pieces of the plurality of puzzle pieces have equal shape and size, the blank areas have equal shape and size.

In some embodiments, the face stock is made of paper, a rear surface thereof is coated by a pressure sensitive adhesive.

In some embodiments, the blank areas are filled with a predetermined color or a predetermined pattern.

the blank areas have a shape of a regular hexagon, the at least one puzzle piece has a shape of a regular hexagon.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

DETAILED DESCRIPTION OF THE PREFERRED EMBODIMENTS

Figure 1:
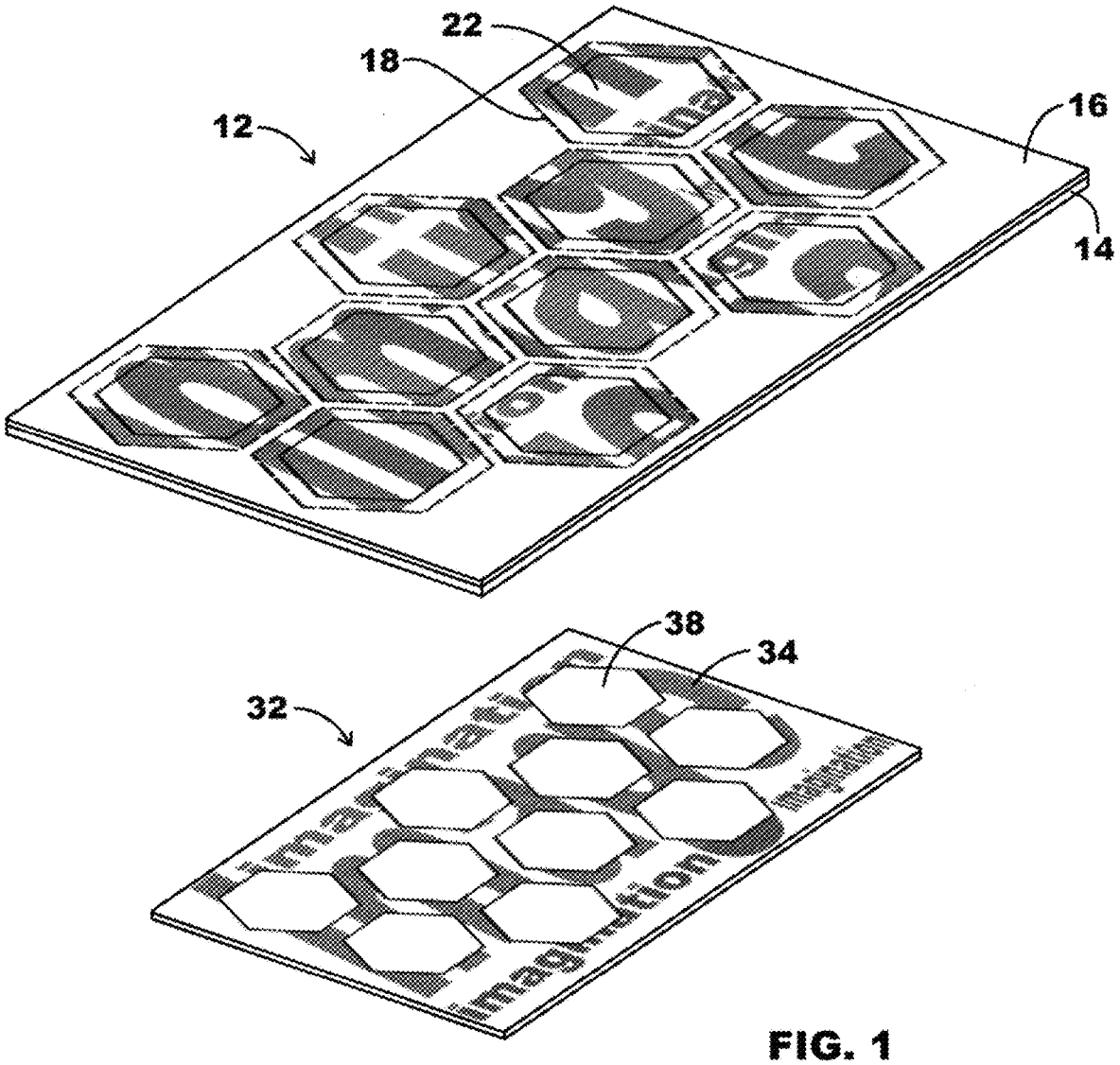
FIG. 1 is a perspective view of a puzzle according to the present invention.

With reference to FIG. 1, a puzzle of the present invention contains a sheet 12 of puzzle pieces and a puzzle assembly sheet 32. Sheet 12 of puzzle pieces contains a release liner 14 and a face stock 16 releasably mounted on the release liner. Face stock 16 is preferably a paper sheet having back surface covered by a low tack pressure sensitive adhesive detachable from release liner 14. (Face stock 16 can be maid of a printable electrostatic material as well, for instance vinyl). Puzzle assembly sheet 32 is preferably made of paper or a paper-based material.

Figure 2:
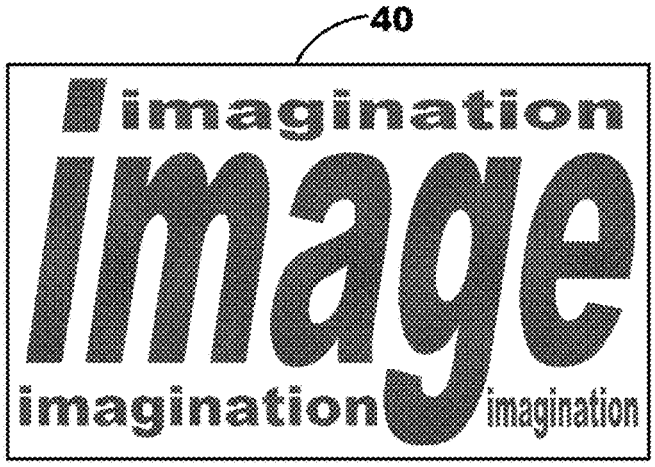
FIG. 2 is an original image of the puzzle.

FIG. 2 illustrates an original image 40 utilized for building puzzle 10 as described hereinbelow. It should be understood that the simplified image based on letters with the background of white color was selected for clarity. Apparently, in real-life implementations, the original puzzle images are mostly colorful and more sophisticated. A final image of puzzle 10 (that is, image of the solved puzzle) is an equivalent of original image 40.

Figure 3:
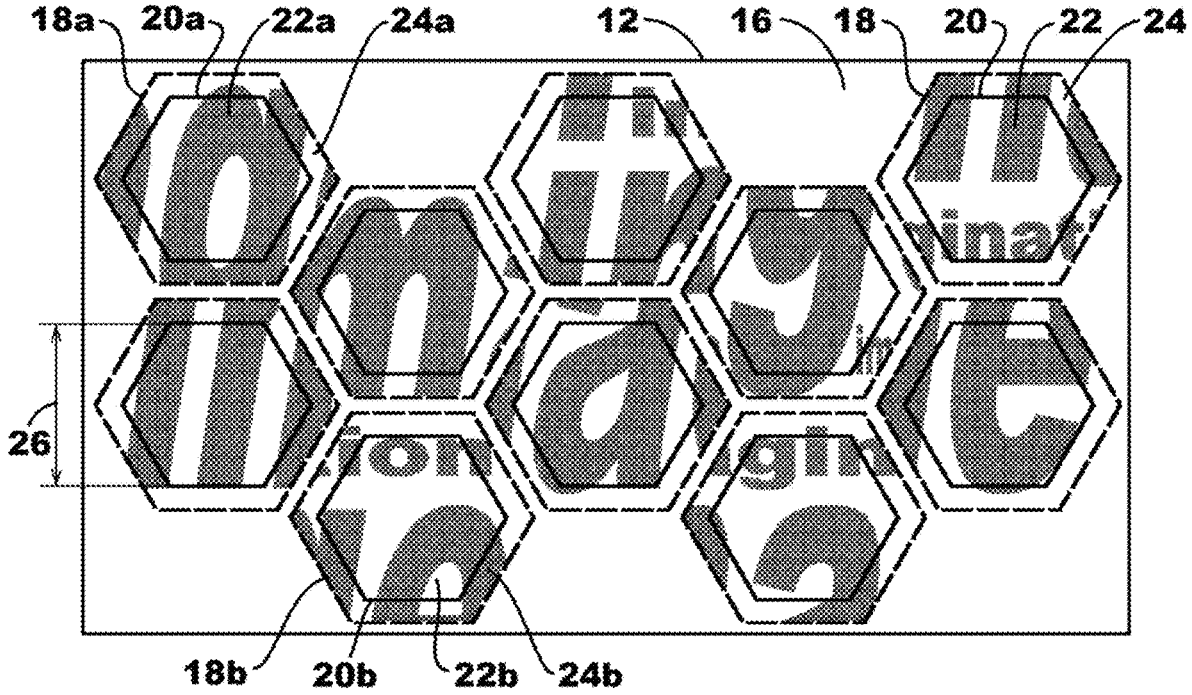
FIG. 3 is a top view of a sheet of puzzle pieces.

FIG. 3 is a top view of sheet 12 of puzzle pieces. A plurality of non-overlapping extended piece images 18 is printed on face stock 16. Two exemplary extended piece images are by numerals 18*a* and 18*b*. Extended piece images 18 each has a boundary shown in FIG. 3 and further in FIG. 5 by dashed lines. It is to be understood that the dashed lines indicating the boundaries of the extended piece images can be presented but not required. Extended piece images 18 are jumbled portions of original image 40; they are built by a method described hereinbelow.

A plurality of cuts 20 cutting through face stock 16, form a plurality of puzzle pieces 22 (namely, the cuts form edges of the puzzle pieces). The cuts and, correspondingly, the puzzle pieces are located inside extended piece images 18. Two exemplary puzzle pieces 22*a* and 22*b* are located inside extended piece images 18*a* and 18*b*, respectively; the corresponding cuts are marked by numerals 20*a* and 20*b*. Cuts 20 are preferably made by kiss-cutting of face stock 16, avoiding cutting release liner 14, such that each of puzzle pieces 22 can be peeled off from the release liner. Cuts 20 can be made by one of the conventional technologies: die-cutting, laser cutting or blade cutting. In printing technology, when cutting a material bearing an image, the image portion that extends beyond the cut is referred to as a bleed zone. Width of bleed zones is normally ⅛" (3.2 mm). Bleed zones related to image areas 18 are marked by numeral 24. For the exemplary image areas 18*a* and 18*b*, corresponding bleed zones are 24*a* and 24*b*.

In the preferred embodiment, extended piece images 18 all have the same shape of a regular hexagon and the same size; they are located in a honeycomb pattern. Accordingly, puzzle pieces 22 all have the same shape of a regular hexagon and the same size (that is because all bleed zones 24 around the puzzle pieces have the same width). Puzzle pieces 22 have linear size 26, which is a distance between any of two opposite sides of the hexagon.

Figure 4:
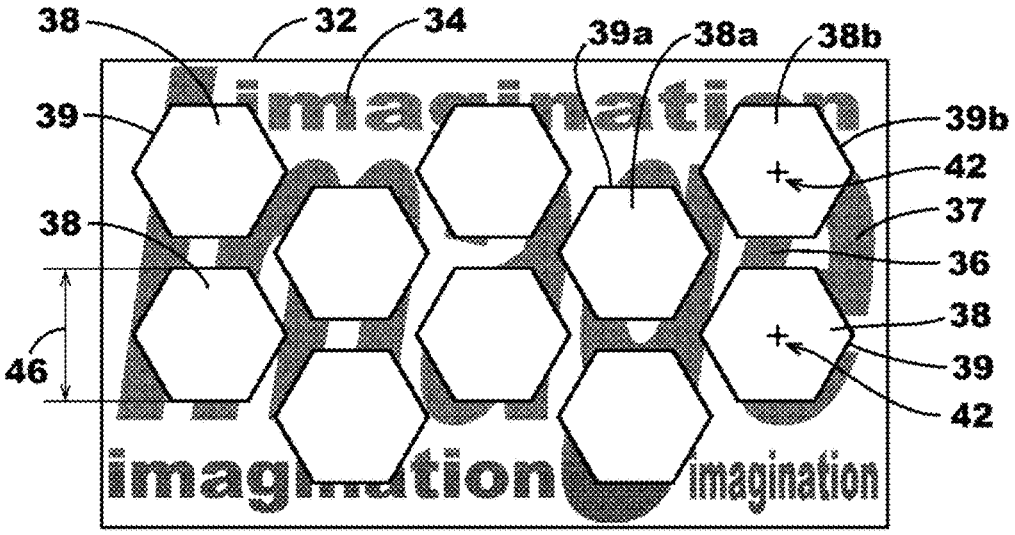
FIG. 4 is a top view of a puzzle assembly sheet.

FIG. 4 is a top view of puzzle assembly sheet 32. A puzzle assembly image 34 printed on the front surface of assembly sheet 32 is a copy of original image 40, having a plurality of blank areas 38 in which the image is blanked out. (Specifically, the blank areas correspond to non-overlapping sections of the source image, having image in the sections blanked out. In the preferred embodiment, blank areas 38 are of white color. (In other embodiments the blank areas can be filled with a monochrome color or with a pattern not related to original image 40). Borders 39 of blank areas 38 are indicated by solid lines. It is to be understood that the solid lines can or can not be presented in the puzzle assembly image 34. If original image 40 does not contain many areas of white or light color, then blank areas 38 are distinguishable without the solid lines indicating their borders. A method of building the puzzle assembly image 34 is: the original image 40 is masked by a set of blank shapes or figures; an image editing software like Photoshop can be used for the purpose.

Similar to the puzzle pieces, all blank areas 38 have shape of a regular hexagon and all have the same size; they are located in a honeycomb pattern; portions of puzzle assembly image 34 located between a couple of neighboring blank areas are marked by numerals 36. Also, there are portions 37 of the puzzle assembly image on the periphery of puzzle assembly sheet 32. Blank areas 38 have linear size 46, which is a distance between any of two opposite sides of the hexagon. Size 46 of the blank areas is smaller than size 26 of the puzzle pieces. Geometrical centers of blank areas 38 are marked by numeral 42. Two exemplary blank areas are marked by numerals 38*a* and 38*b* and their borders by numerals 39*a* and 39*b*, respectively.

Goal of the puzzle is to build a final puzzle image by peeling puzzle pieces 22 off sheet 12 of puzzle pieces and sticking them on the front surface of puzzle assembly sheet 32 such that the pieces cover blank areas 38. If the puzzle pieces are placed on the puzzle assembly sheet correctly, images of the puzzle pieces collectively form the final puzzle image. Portions 36 and 37 of the puzzle assembly image (FIG. 4) serve as guides or tips for placing the puzzle piece correctly.

As specified hereinabove, back surface of face stock 16 is covered by a low tack pressure sensitive adhesive. Thereby, when placed on front surface of the puzzle assembly sheet 32, puzzle pieces 22 stay secure thereon.

Figure 5:
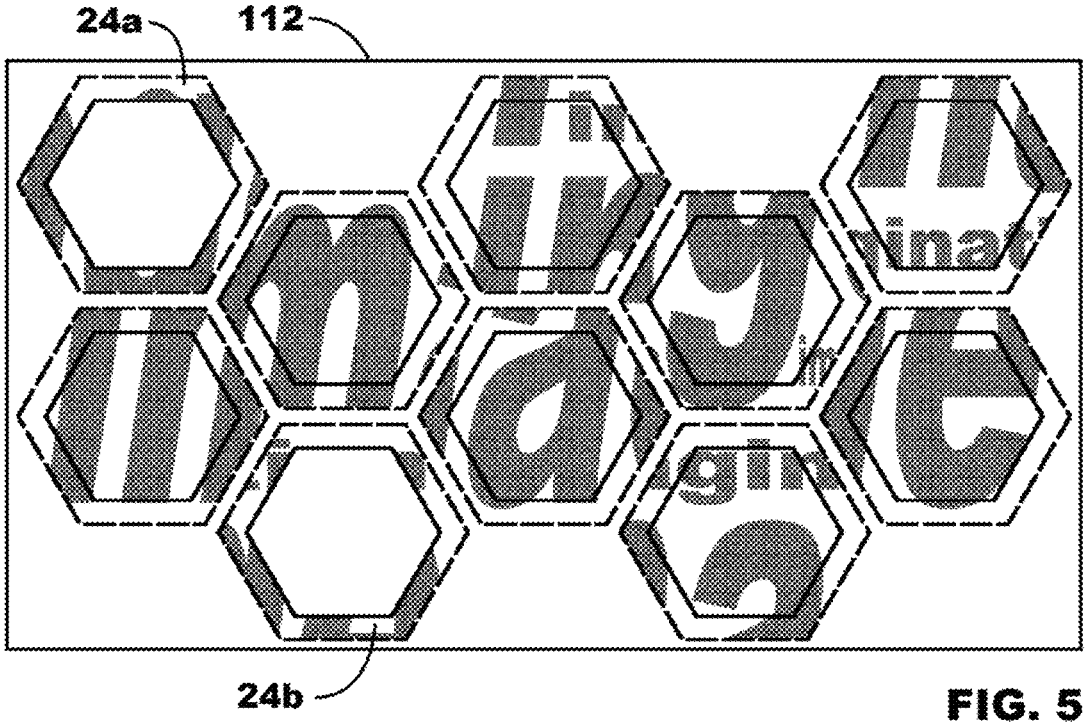
FIG. 5 is a top view of the sheet of puzzle pieces with two pieces removed.

While FIG. 3 illustrates sheet 12 of puzzle pieces with all pieces intact, FIG. 5 illustrates the same sheet of puzzle pieces, marked here by numeral 112, with two exemplary puzzle pieces 22*a* and 22*b* (see FIG. 3) being removed from it. Bleed zones 24*a* of 24*b*, related to puzzle pieces 22*a* and 22*b*, remain intact on the sheet 112 of puzzle pieces.

Figure 6:
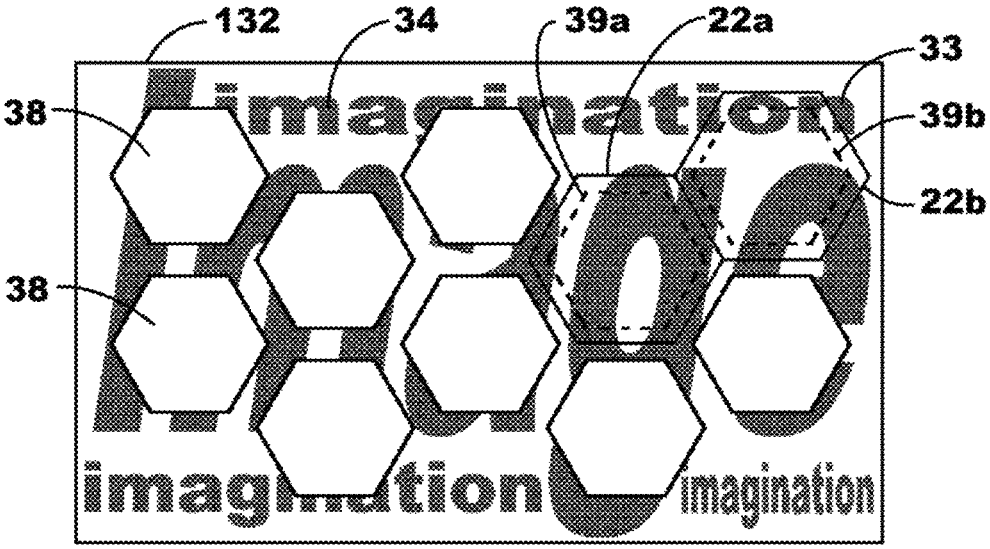
FIG. 6 is a top view of puzzle assembly sheet with two puzzle pieces stuck on it.

Similarly, while FIG. 4 illustrates puzzle assembly sheet 32 in its initial state, FIG. 6 illustrates the same puzzle assembly sheet marked here by numeral 132, having two exemplary puzzle pieces 22*a* and 22*b* stuck on it over the exemplary blank areas 38*a* and 38*b* (see the blank areas on FIG. 4). As specified hereinabove, size of puzzle pieces 22 is bigger than size of blank areas 38. Thereby, when a puzzle piece 22 is placed on the puzzle assembly sheet overlying a corresponding blank area 38 in a particular location with a particular orientation, the puzzle piece covers a portion of the puzzle assembly image 34, specifically the portion that directly surround the blank area. When exemplary puzzle pieces 22*a* and 22*b* are placed on puzzle assembly sheet 132 in their respective correct locations, they cover the respective borders 39*a* and 39*b* of the blank areas and portions of puzzle assembly image 34 surrounding the blank areas. Borders 39*a* and 39*b* are shown on FIG. 6 by dashed lines because they are invisible being covered by puzzle pieces 22*a* and 22*b*.

Figure 7:
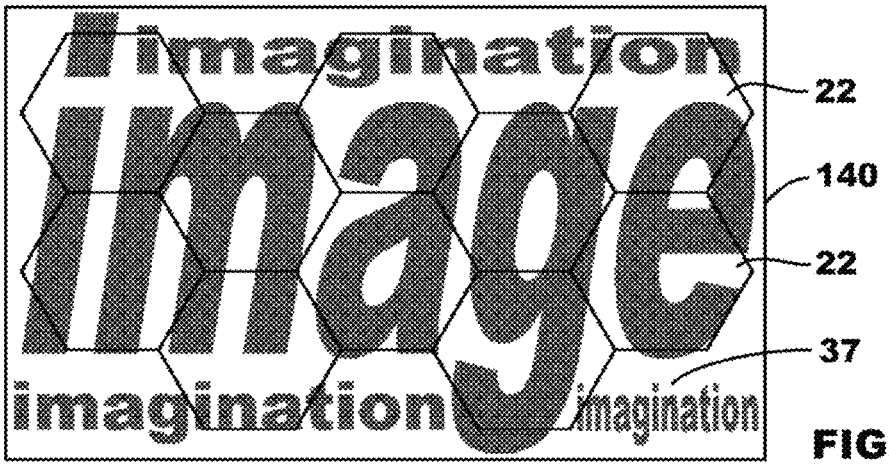
FIG. 7 is a top view of the solved puzzle.

When a puzzle piece is placed correctly on the puzzle assembly sheet overlying a corresponding blank area as described in the previous paragraph, a portion of puzzle assembly image 34 that remains uncovered by the puzzle piece is complementary to the image printed on the puzzle piece. For instance, the original puzzle image contains letter "n" in the upper right corner (FIG. 2). A portion of that letter is in the upper right corner of puzzle piece 22*b*, see the puzzle piece defined by cut 20*b* on puzzle assembly sheet 12, FIG. 3. As seen in FIG. 6, that portion of the letter on puzzle piece 22*b* and a portion 33 of that letter on the puzzle assembly sheet adjoining the puzzle piece are complementary to each other. Size of puzzle pieces 22 and location of blank areas 38 on assembly sheet 32 are such, that when all puzzle pieces 22 are placed on puzzle assembly sheet 32 adjoining each other, each one in a correct position, an overall image 140 of the solved puzzle is an equivalent of original image 40 of the puzzle, as illustrated in FIG. 7. Overall image 140 of the solved puzzle is a combination of images printed on puzzle pieces 22 and portions 37 of the puzzle assembly image on the periphery of puzzle assembly sheet 32.

Figure 8:
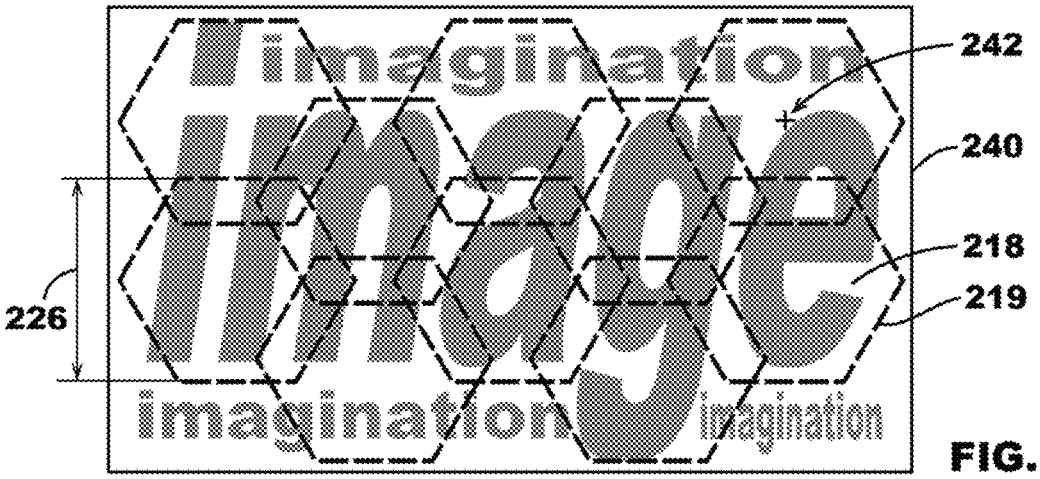
FIG. 8 is the original puzzle image with designated extended piece images.
Figure 9:
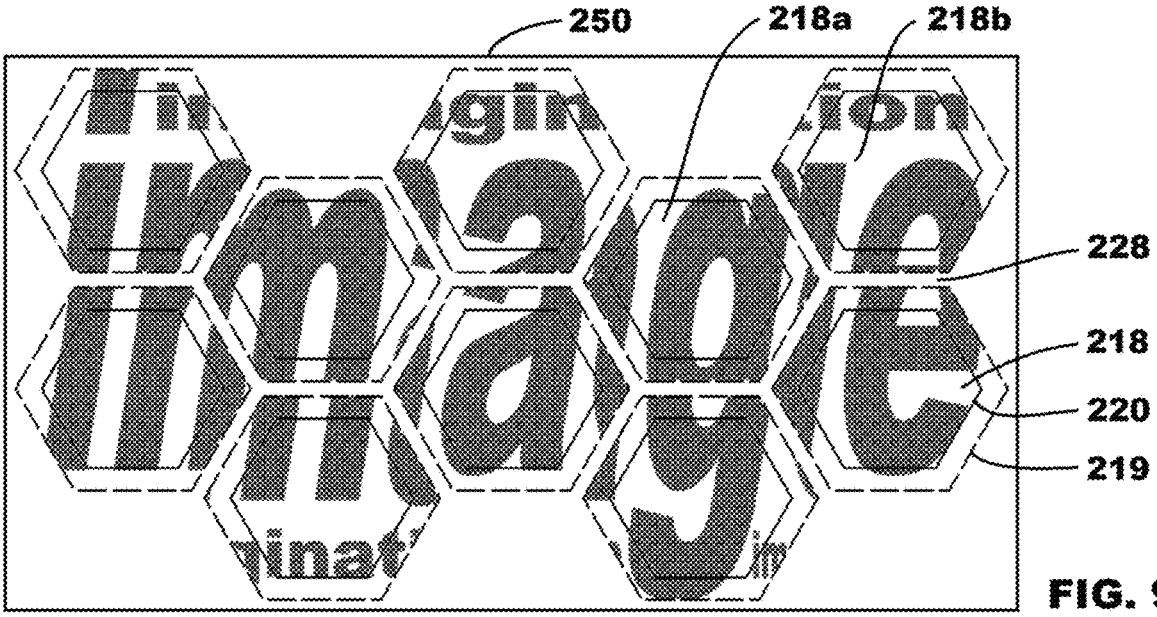
FIG. 9 is an intermediate image having the extended piece images placed apart from each other.

Below is a step-by-step description of a method of building the image printed on sheet 12 of puzzle pieces. FIGS. 8 and 9 illustrate the method.

The 1st step is illustrated in FIG. 8. On the puzzle original image 240, which is a copy of the original image 40), a plurality of extended piece images 218 is designated by drawing boundaries 219 thereof. Each of the boundaries is indicated by a dashed line. In the describing embodiment of the present invention, the extended piece images 218 all have shape of a regular hexagon, have equal size and each of them overlap the adjacent ones. Extended piece images 218 correspond to extended piece images 18 illustrated in FIGS. 3 and 5. Linear size 226 of extended piece images 218 is bigger than linear size 46 of blank areas 38 (FIG. 4).

As specified hereinabove, a portion of puzzle assembly image 34 adjoining a puzzle piece, which is correctly placed on the puzzle assembly sheet, is complementary to the image printed on the puzzle piece. That is being achieved through the following. Positions of extended piece images 218 relative to the original image 240 (see FIG. 8) are such that geometrical centers thereof coincide with geometrical centers of blank areas 38 of assembly sheet 32 relative to the original image as seen in FIG. 4. That is because image printed on the front surface of the assembly sheet is a copy of original image 40, having blank areas where the original image is blanked out. As an example, an extended piece image located in the upper right corner of the original image 240 (FIG. 8) has a geometrical center 242. A blank area located in the upper right corner of assembly sheet 32 (FIG. 4) has a geometrical center 42. Comparing FIG. 4 and FIG. 8, it can be seen that positions of the geometrical centers 242 and 42 relative to the original image of the puzzle coincide.

The 2nd step is illustrated in FIG. 9. An intermediate image 250 is built by placing the extended piece images 218 apart such that there are narrow spaces 228 of a uniform width between any pair of adjacent extended images 218. Two exemplary extended piece images are 218*a* and 218*b*, they correspond to extended piece images 18*a* and 18*b* (see FIG. 3), respectively, as explained hereinbelow.

In the 3rd step, a cutting line 220 of shape of regular hexagon is drawn inside each of the extended piece images 218 (see FIG. 9). Cutting lines 220 correspond to cuts 20, which define the puzzle pieces 22 (see FIG. 3).

The 4th step is jumbling the extended piece images 218, which means that each image in the plurality of extended piece images 218 is re-positioned to a spot taken be some other image in the plurality, in a random manner. The image printed on the sheet 12 of puzzle pieces (see FIG. 3) is the result of the jumbling. Through the jumbling, for instance, the extended piece images 218*a* and 218*b* in FIG. 9 have being moved to the new positions on the sheet 12 of puzzle pieces where they are marked as extended piece images 18*a* and 18*b*, respectively.

Although the present invention has been explained in relation to its preferred embodiment, it should be understood that many other possible modifications and variations can be made without departing from the spirit and scope of the invention described hereinabove. Hereinbelow are examples of such variations.

Some steps of the described hereabove method of building the image printed on the sheet of puzzle pieces can be modified or combined with other steps; new steps can be added. For instance, the 2nd and 3rd steps can be combined: the extended piece images 218 are placed apart and jumbled in a single step, without building the intermediate image 250. Another option: additionally to the jumbling of extended piece images 218, some of them (randomly selected) can be turned around their corresponding geometrical centers by 60, 120, 180, 240 or 300 degrees, which makes the puzzle more challenging.

Figure 10:
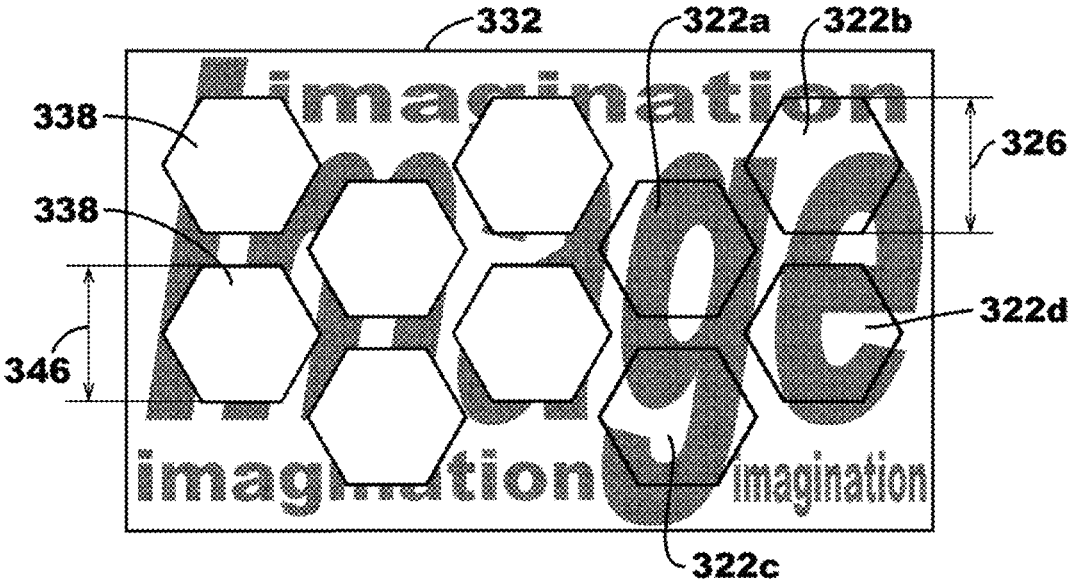
FIG. 10 is a top view of a puzzle assembly sheet as per a different embodiment.
Figure 11:
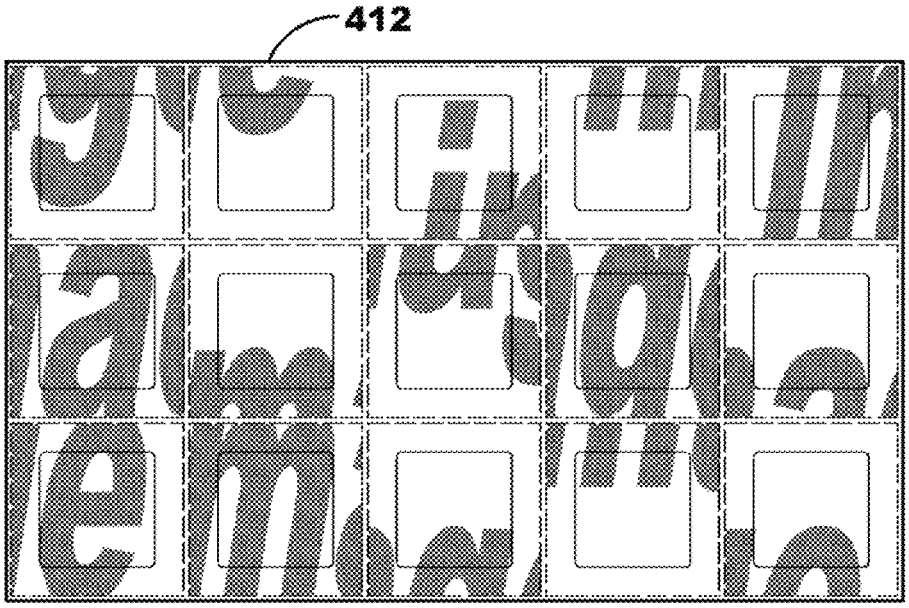
FIG. 11 is a top view of a sheet of puzzle pieces where the pieces have a square shape.

Further, an embodiment where size of puzzle pieces is smaller than the size per the preferred embodiment have been contemplated. In that embodiment, size of the puzzle pieces is still bigger than size of the blank areas. In a solved puzzle per such that embodiment, puzzle pieces are not adjoining each other, so portions of the puzzle assembly image are being left un-covered by the puzzle pieces and, collectively with images on the puzzle pieces, form the final puzzle image. FIG. 10 illustrates such embodiment. A puzzle assembly sheet 332 having a set of blank areas 338 is the same as assembly sheet 32 in FIG. 4. Four exemplary puzzle pieces 322*a*, 322*b*, 322*c* and 322*d* are being stuck on puzzle assembly sheet 332 over the corresponding blank areas. Linear size 326 of the puzzle pieces is slightly bigger than linear size 346 of blank areas 338. As seen in FIG. 10, which shows the puzzle not fully solved, the puzzle pieces are not adjoining each other.

Still further, in the embodiments described hereinabove the puzzle pieces have hexagonal shape of a uniform size. It should be understood that puzzle pieces in the present invention can have different than that, and also can have non-uniform shape and non-uniform size. The same is applicable to the blank areas of the puzzle assembly image. For instance, FIG. 10 illustrates a sheet 412 of puzzle pieces having a square shape. Other options of the puzzle pieces' shapes (and, correspondingly, shapes of the blank areas) of the following polygons: triangle, rectangle, trapezium, hexagon, octagon, and so on; the polygons can have rounded corners. Shapes other than polygons, for instance ovals, have been contemplated as well.

It has to be understood that in some embodiments of the presented puzzle, portions on the original image can be presented not only on periphery of the puzzle assembly image but in other areas thereof as well. For instance, the puzzle assembly image 34 (FIG. 4), instead of having ten blank areas, can have eight of them, such that two blank areas in the middle (that is in the third column) are not being blanked out. In puzzles with a large number of puzzle pieces such "isles" of non-blanked original image areas in different portions of puzzle assembly image would help a player in solving the puzzle.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of the steps in the method described hereinabove is also contemplated and within the scope of the invention.

What is claimed is:

1. A puzzle comprising:

(a) a sheet of puzzle pieces comprising a release sheet and a face stock detachably coupled thereto, a front surface of said face stock has at least one extended piece image provided thereon covering at least one sector of said front surface, said at least one extended piece image corresponds to at least one region of a source image, at least one closed-shape cut laying inside said at least one sector cuts through said face stock so forming at least one puzzle piece having at least one puzzle piece image provided thereon; and (b) a puzzle assembly surface having a puzzle assembly image provided thereon, said puzzle assembly image including:

(i) blank areas corresponding to non-overlapping sections of said source image, said blank areas each having an image therein blanked out; and (ii) a background puzzle image corresponding to complementary sections of said source image which are complementary to said non-overlapping sections of said source image;

wherein shape and size of said at least one puzzle piece and said at least one puzzle piece image provided thereon are such that, when said at least one puzzle piece is placed upon said puzzle assembly surface in a particular position with a particular orientation, said at least one puzzle piece covers a region of said puzzle assembly image including a particular blank area of said blank areas and a portion of said background puzzle image directly adjoining said particular blank area such that said at least one puzzle piece image is complementary to a portion of said background puzzle image that is left uncovered by said at least one puzzle piece;

thereby, when said at least one puzzle piece is placed on said puzzle assembly surface in said particular position with said particular orientation, said at least one puzzle piece image together with regions of said background puzzle image that are uncovered by said at least one puzzle piece, collectively form an image that is generally identical to said source image.

2. The puzzle of claim 1, wherein said at least one extended piece image includes a plurality of extended piece images corresponding to a plurality of regions on said source image, said at least one puzzle piece includes a plurality of puzzle pieces and said at least one puzzle piece image includes a plurality of puzzle piece images.

3. The puzzle of claim 2, wherein extended piece images of said plurality of extended piece images are jumbled relatively to corresponding regions of said plurality of regions on said source image.

4. The puzzle of claim 2, wherein quantity of puzzle pieces of said plurality of puzzle pieces is equal to quantity of said blank areas.

5. The puzzle of claim 2, wherein puzzle pieces of said plurality of puzzle pieces have equal shape and size, said blank areas have equal shape and size.

6. The puzzle of claim 1, wherein said face stock is made of paper.

7. The puzzle of claim 6, wherein a rear surface of said face stock is coated by a pressure sensitive adhesive.

8. The puzzle of claim 1, wherein said puzzle assembly surface is made of paper.

9. The puzzle of claim 1, wherein said blank areas are filled with a predetermined color or a predetermined pattern.

10. The puzzle of claim 1, wherein said blank areas have a shape of a regular hexagon, said at least one puzzle piece has a shape of a regular hexagon.

11. The puzzle of claim 1, wherein said blank areas and said at least one puzzle piece have shape of one of the following polygons: (i) triangle; (ii) rectangle; (iii) trapezium; (iv) hexagon and (v) octagon.

12. The puzzle of claim 11, wherein said polygons have rounded corners.

* * * * *